United States Patent [19]

Imai et al.

[11] 4,327,702

[45] May 4, 1982

[54] PLASMA JET IGNITION SYSTEM WITH NOISE SUPPRESSING ARRANGEMENT

[75] Inventors: Iwao Imai, Yokosuka; Masazumi Sone, Yokohama, both of Japan

[73] Assignee: Nissan Motor Co., Ltd., Tokyo, Japan

[21] Appl. No.: 141,694

[22] Filed: Apr. 18, 1980

[30] Foreign Application Priority Data

Apr. 23, 1979 [JP] Japan ..... 54-50561
May 29, 1979 [JP] Japan ..... 54-72892[U]

[51] Int. Cl.[3] ..... F02P 1/00
[52] U.S. Cl. ..... 123/620; 123/633; 123/655
[58] Field of Search ..... 123/633, 620, 640, 655

[56] References Cited

U.S. PATENT DOCUMENTS

| | | | |
|---|---|---|---|
| 2,238,915 | 4/1941 | Peters | 123/633 |
| 2,322,773 | 6/1943 | Peters | 123/633 |
| 2,447,782 | 8/1948 | Welge | 123/633 |
| 3,492,622 | 1/1970 | Hayashi | 123/633 |
| 3,965,879 | 6/1976 | Fitzner | 123/633 |
| 4,078,534 | 3/1978 | Mayer | 123/633 |
| 4,186,712 | 2/1980 | Fitzner | 123/633 |

*Primary Examiner*—Ronald B. Cox
*Attorney, Agent, or Firm*—Lane, Aitken, Kice & Kananen

[57] ABSTRACT

A plasma jet ignition system wherein a plasma jet energy storage system is used in conjunction with a spark energy storage system to provide energy to a plasma jet ignition plug. For the purpose of suppressing noise due to the spark discharge, a spark energy delivery cable takes the form of a high tension resistance cable and a plasma jet energy delivery cable takes the form of a lead including a coil and having a distributed inductance.

12 Claims, 11 Drawing Figures

PLASMA JET IGNITION SYSTEM WITH NOISE SUPPRESSING ARRANGEMENT

BACKGROUND OF THE INVENTION

The present invention relates to a plasma jet ignition system, and more particularly to a plasma jet ignition system for an automotive internal combustion engine with an arrangement to suppress noise.

It is known that a spark discharge generated in an ignition system radiates noise. The noise disturbs radio broadcasing service, television broadcasting service and other kinds of radio communication systems. Further, the noise also causes operational errors in electronic control circuits used as vehicle control systems, such as electronic controlled fuel injection systems or electronic controlled skid control systems, and as a result traffic safety will be threatened. Therefore, it is strongly demanded to suppress noise.

In order to increase ignition capability, there has been proposed a plasma jet ignition system such as illustrated in FIG. 1 which comprises a spark energy storage system 1 which provides the basic spark timing and high voltage trigger signal to plasma jet ignition plugs via a distributor (not shown), only one plasma jet spark plug being shown at 3, and a plasma jet energy storage system 2. The spark energy storage system 1 comprises a battery 4, an ignition coil 7 having a primary winding connected to the battery 4 and a secondary winding, and a breaker 6 with an actuating cam 5 connected to the ignition coil 7. The plasma jet energy storage system 2 comprises a high voltage power supply schematically represented by a battery 8, a charging resistor 9, a storage capacitor 10, and a choke coil 11 which limits the peak value of the discharge current from the discharge capacitor 10 and controls the discharge duration. To prevent the spark energy from flowing into the storage capacitor 10, a steering diode 12 is arranged. The plasma jet ignition plug 3 has a first or rod shaped electrode 3*a*, a second electrode 3*b* and a substantially enclosed plasma cavity 3*c* between the first and second electrodes 3*a*, 3*b*. The first electrode 3*a* is connected to a spark energy delivery cable which is in the form of a high tension resistance cable 14, and also to a plasma jet energy delivery cable 13. The second electrode 3*b* is grounded. When sufficiently high potential is applied across the first and second electrodes 3*a*, 3*b*, upon opening of the breaker 6, to cause electrical breakdown of the plasma cavity gap, the energy stored on the storage capacitor 10 is now dumped into the plasma cavity gap by the discharge current. With sufficient electrical energy being supplied to the plasma cavity 3*c* during a sufficiently short time period, a jet of plasma is produced. A portion of the plasma jet within the plasma cavity 3*c* is ejected out of the plasma cavity 3*c* into the combustion space to ignite the air fuel mixture therein. Ignition capability is thus increased with a plasma jet.

A problem with this plasma jet ignition system resides in that there is no effective way to suppress noise radiated from the plasma jet energy delivery cable and plasma jet plug, although noise from the spark energy delivery cable is effectively suppressed by the use of a high tension resistance cable.

There has been a proposal to employ a high tension resistance cable for the plasma jet energy delivery cable or to employ a resistance plasma jet ignition plug which has an electrode containing a resistance. This proposal is defective in that an increase in resistivity causes a reduction in plasma jet energy to an unacceptable low level, deteriorating the ignition capability.

An object of the present invention is to provide a plasma jet ignition system with an effective noise suppressing arrangement wherein without deteriorating plasma jet energy noise is suppressed.

The invention will be hereinafter described in connection with the accompanying drawings:

DETAILED DESCRIPTION OF THE INVENTION

Figure 1:
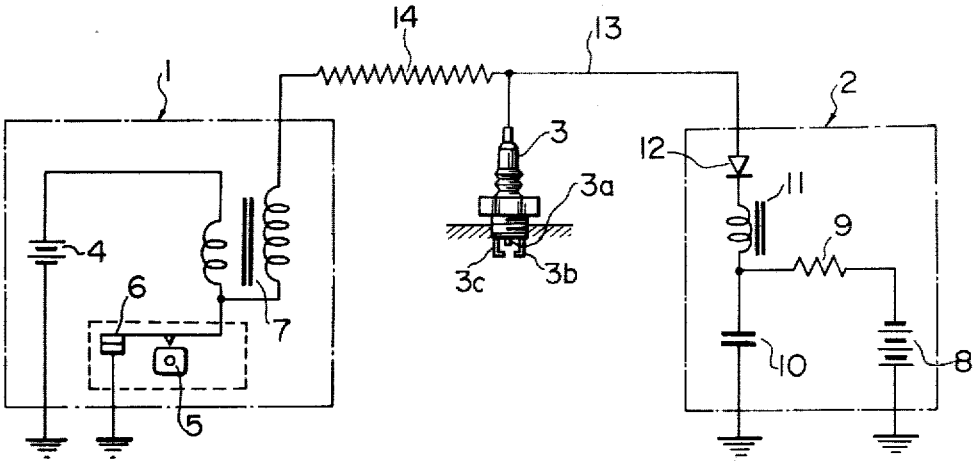
FIG. 1 PRIOR ART
FIG. 1 is a circuit diagram of a prior art plasma jet ignition system.
Figure 2:
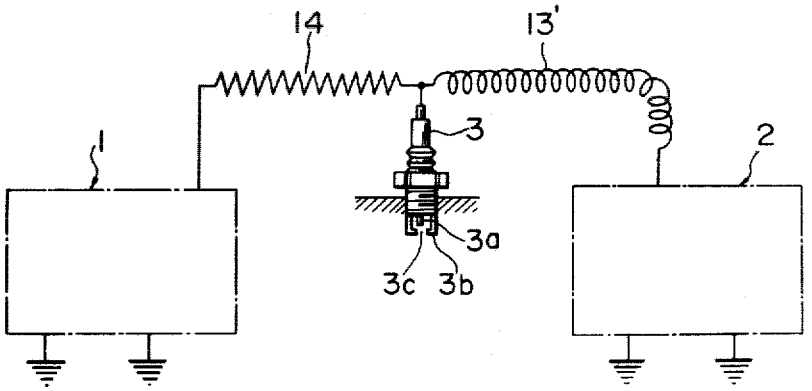
FIG. 2 is a block diagram of a first embodiment of a plasma jet ignition system arrangement according to the present invention.

Referring to FIG. 2, like reference numerals used in FIG. 1 are used to designate like parts, wherein the reference numeral 1 designates a spark energy storage system; 2 a plasma jet energy storage system; and 3 a plasma jet ignition plug. The reference numeral 14 designates a spark energy delivery cable in the form of a high tension resistance cable. Noise radiation from the spark energy delivery cable is suppressed with the use of the high tension resistance cable.

Figure 3:
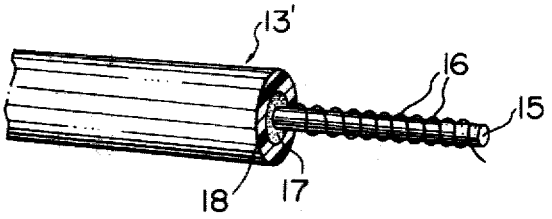
FIG. 3 is a perspective view, partly in section, of the plasma jet energy delivery cable in the form of a wire-wound noise prevention lead used in FIG. 2.

The reference numeral 13' designates a plasma jet energy delivery cable. The plasma jet energy delivery cable takes the form of a wire-wound coil or a wire-wound noise prevention lead as shown in FIG. 3. This wire-wound noise prevention lead 13' connects the plasma jet ignition plug 3 to the plasma jet energy storage system 2. High frequency components of noise can be filtered by the coil. A characteristic impedance $Z_0$ of the plasma jet energy delivery cable 13' has increased, owing to a distributed inductance of the coil and a floating capacity C, and has a value to effect mismatching with high frequency components of noise thus damping these components. As illustrated in FIG. 3, the wire-wound noise prevention lead 13' is constructed of a fine core 15, a conducting wire 16 winding to the core 15, a magnetic materal 17, for example, a ferrite, enclosing the conducting wire 16, and a resin 18 enclosing the magnetic material 17. The magnetic material 17 is effective to give a loss to the high frequency components of the noise, thus effectively damping the high frequency components of the noise.

Figure 4:
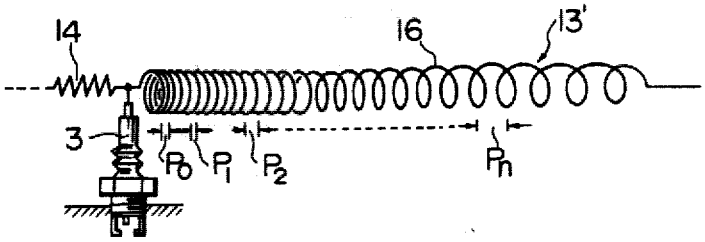
FIG. 4(A) is a diagram showing one winding which is effective to suppress noise.
FIG. 4(B) is a diagram showing another winding which is also effective to suppress noise.
Figure 4:
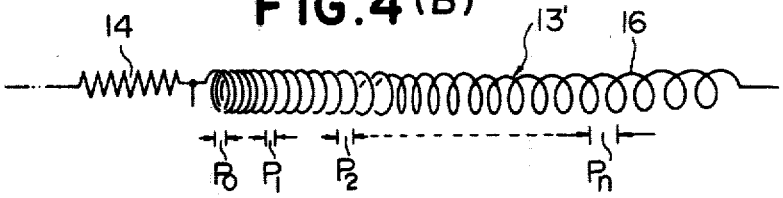

More effective noise suppression can be accomplished by providing a winding pitch as shown in FIG. 4(A) or 4(B). A winding pitch of the wire-wound noise prevention lead is smaller in the proximity of the plasma jet ignition plug 3 than that within the remaining portion of the wire-wound noise prevention lead. In the case of FIG. 4(A), the winding pitch $P_0 \ldots P_n$ varies gradually and continuously, while, in the case of FIG. 4(B), the winding pitch varies stepwise.

With the arrangement mentioned above, the noise radiated by the spark discharge at the plasma jet ignition plug is prevented from radiating from the spark energy delivery cable 14 and plasma jet energy delivery cable 13', thus reducing the noise electric field intensity (dB) to a sufficiently low level.

Figure 5:
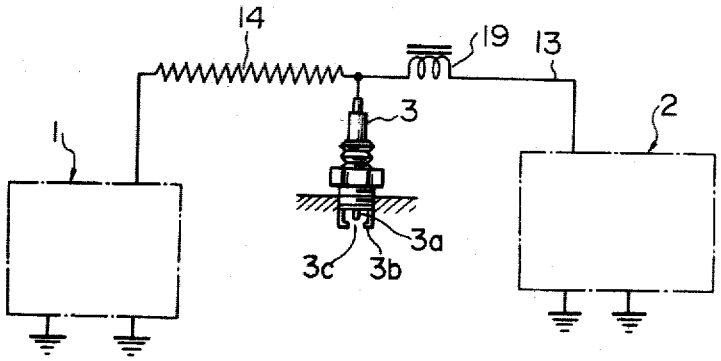
FIG. 5 is a block diagram of a second embodiment of a plasma jet ignition system arrangement according to the present invention.

FIG. 5 shows a second embodiment of the present invention, wherein like reference numerals are used to designate like parts. In this embodiment, a choke coil 19 is disposed within a plasma energy delivery cable 13. The provision of the coil 19 is effective in reducing the noise electric field intensity. Preferably, the coil 19 is arranged in the proximity of the plasma jet ignition plug 3.

Figure 6:
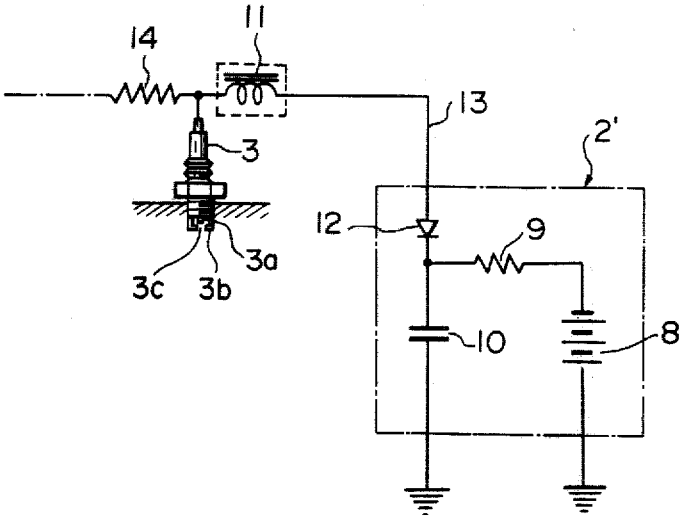
FIG. 6 is a partial circuit diagram of a third embodiment of a plasma jet ignition system arrangement according to the present invention.

As shown in FIG. 6, instead of providing another choke coil in addition to the peak current limiting choke coil that is always provided in the plasma energy storage system 2, a similar result is given even if the choke coil 11 is displaced into the plasma energy delivery cable 13 so as to serve the function of the above described noise suppressing coil. The setting of inductance of the noise suppressing coil differs from one system to another. In the event both of the peak current limiting choke coil and the noise suppressing coil are used, noise prevention effectiveness was recognized when the inductance is more than 10 $\mu$H. In the event the choke coil has the dual function of limiting of peak current and of prevention of noise, the order of 10 mH is at least necessary for the purpose of limiting the peak current.

Figure 7:
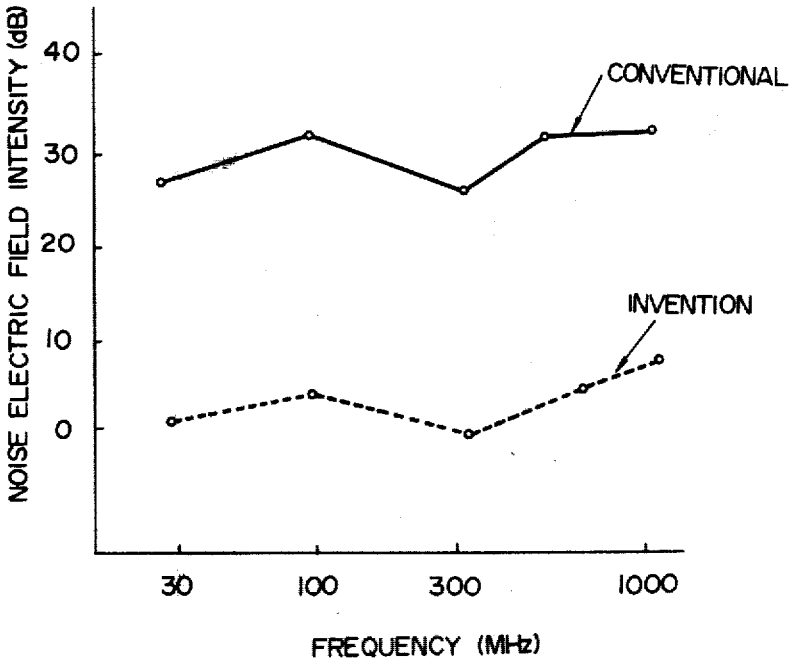
FIG. 7 is a graph of noise electric field intensity (dB) versus frequency (MHz)

It was confirmed from the comparison of the frequency-noise versus frequency provided by the ignition system according to the present invention with that provided by the conventional ignition system as shown in FIG. 1 that, as shown in FIG. 7, a reduction of approximately 30 dB in noise electric field intensity was obtained by the present invention as compared to the conventional ignition system.

Figure 8:
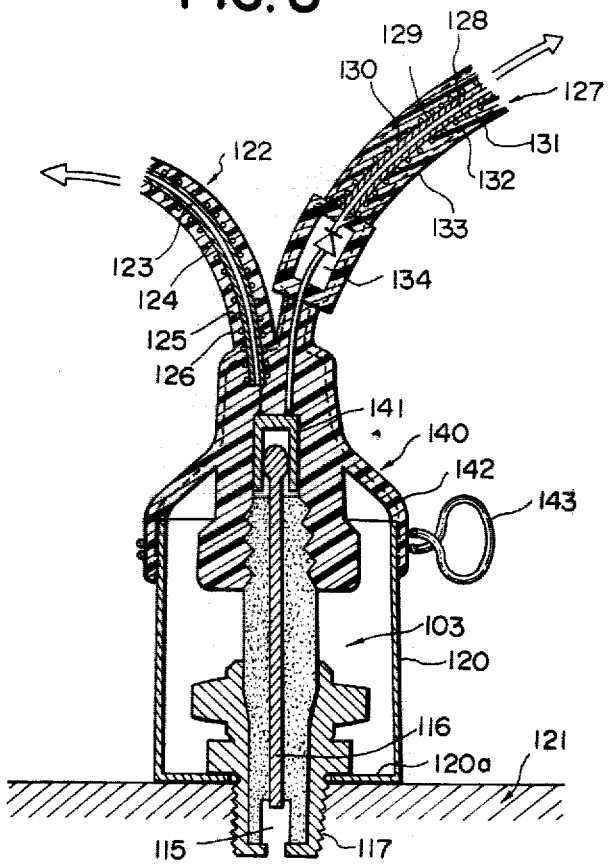
FIG. 8 is a sectional view of a portion of a fourth embodiment of a plasma jet ignition system arrangement according to the present invention.
Figure 9:
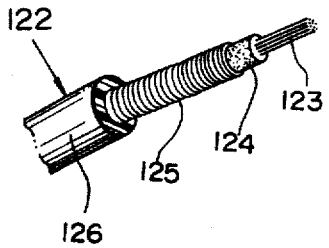
FIG. 9 is a perspective view, partly in section, of the spark energy delivery cable used in FIG. 8.
Figure 10:
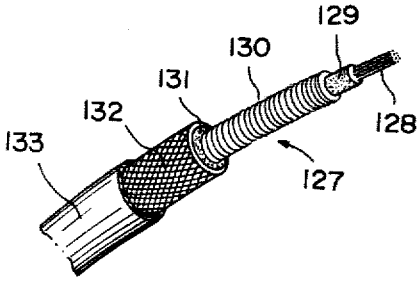
FIG. 10 is a perspective view, partly in section, of the plasma jet energy delivery cable used in FIG. 8.

Reference is now made to FIGS. 8 through 10 to describe the last embodiment of the present invention. A plasma jet ignition plug 103 is attached to a cylinder head 121 via an attachment end plate 120*a* of a metal cylindrical box 120.

A spark ignition energy delivery cable 122 is in the form of a high tension resistance cable constructed such that a metal resistance wire 125 winds to a core made of glass fibers 123 covered with a ferrite 124 and the metal resistance wire 125 is covered with an insulator 126 made of rubber, and connects with a metal connector 141 of a plug cap 140.

A plasma energy delivery cable 127 is constructed such that a conducting wire winds to a core that is made of glass fibers 128 covered with a ferrite 129 to form coil 130. This coil 130 is first covered with an insulator 131, then wire metal screen or mesh 132 and then an insulator 133, and connects with the metal connector 141 of the plug cap 140. The metal mesh 132 extends from the plasma energy delivery cable 127 to the open end of a flare portion 142 of the plug cap 140 and is exposed from the inner surface of the flare portion 142 to contact with the outer peripheral surface of the metal cylindrical box 120. The plug cap 140, after receiving the plasma jet ignition plug 103, is fixed to the metal cylindrical box 120 by a band 143 so that the metal mesh 132 exposed from the inner surface of the flare portion 142 contacts with the outer peripheral surface of the metal cylindrical box 120.

Since the plasma jet ignition plug 103 and plasma jet energy delivery cable 127 are enclosed by the metal cylindrical box 120 and the metal mesh 132, wave noise is shielded by the electrostatic shielding effect. Since, in the case of the plasma jet energy delivery cable 127, it is constructed of the coil 130 and a steering diode 134 is disposed in the proximity of the spark plug, the effect of distributed inductance of the coil 130 and the detection function by the diode 134 cause a further reduction in wave noise. According to the experiment, noise reduction effect of the mean value of 20 to 30 dB was recognized within the frequency band of 30 to 1,000 MHz as compared to the conventional case.

What is claimed is:

1. A plasma jet ignition system comprising:

a spark energy storage system;

a plasma jet energy storage system;

a plasma jet ignition plug;

a spark energy delivery cable in the form of a high tension resistance cable connecting said plasma jet ignition plug to said spark energy storage system;

a plasma jet energy delivery cable connecting said plasma jet ignition plug to said plasma jet energy storage system, said plasma jet energy delivery cable including an electrically conductive coil in the form of a wire-wound noise prevention lead and having one end connected to said plasma jet ignition plug and an opposite end connected to said plasma jet energy storage system, the winding pitch of said coil being chosen so as to filter high frequency components, and wherein the winding pitch of said coil in the proximity of said plasma jet ignition plug is smaller than that within the remaining portion of said coil.

2. A plasma jet ignition system comprising:

a spark energy storage system;

a plasma jet energy storage system;

a plasma jet ignition plug;

a spark energy delivery cable in the form of a high tension resistance cable connecting said plasma jet ignition plug to said spark energy storage system;

a plasma jet energy delivery cable connecting said plasma jet ignition plug to said plasma jet energy storage system, said plasma jet energy delivery cable including an electrically conductive coil having one end connected to said plasma jet ignition plug and an opposite end connected to said plasma jet energy storage system, the winding pitch of said coil being chosen so as to filter high frequency components, and wherein said plasma jet energy delivery cable includes a tube of a conducting material enclosing a space through which said conductor extends, and including a box of a conducting material enclosing a space wherein said plasma jet ignition plug is disposed, said tube having a flare portion contacting with the outer surface of said box to close said space wherein said plasma jet ignition plug is disposed.

3. A plasma jet ignition system comprising:
a spark energy storage system;
a plasma jet energy storage system;
a plasma jet ignition plug;
a spark energy delivery cable in the form of a high tension resistance cable connecting said plasma jet ignition plug to said spark energy storage system;
a plasma jet energy delivery cable connecting said plasma jet ignition plug to said plasma jet energy storage system, said plasma jet energy delivery cable having a conductor connecting said plasma jet ignition plug to said plasma jet energy storage system, an enclosure of a conducting material enclosing said conductor and said plasma jet ignition plug so as to shield a space wherein said conductor and said plasma jet ignition plug are disposed, said conductor including a coil and having a distributed inductance.

4. A plasma jet ignition system comprising:
a spark energy storage system;
a plasma jet energy storage system;
a plasma jet ignition plug;
a spark energy delivery cable in the form of a high tension resistance cable connecting said plasma jet ignition plug to said spark energy storage system;
a plasma jet energy delivery cable connecting said plasma jet energy delivery cable including a core; an electrically conductive wire winding around said core, said electrically conductive wire having one end connected to said plasma jet ignition plug and an opposite end connected to said plasma jet energy storage system; a magnetic material enclosing said electrically conductive wire; and an electrically insulative resin enclosing said magnetic material.

5. A plasma jet ignition system comprising:
a spark energy storage system;
a plasma jet energy storage system;
a spark energy delivery cable in the form of a high tension resistance cable connecting said plasma jet ignition plug to said spark energy storage system;
a cylindrical metal box enclosing said plasma jet ignition plug; and
a plasma jet energy delivery cable connecting said plasma jet ignition plug to said plasma jet energy storage system, said plasma jet energy delivery cable including,
a core;
an electrically conductive wire winding around said core, said electrically conductive wire having one end connected to said plasma jet ignition plug and an opposite end connected to said plasma jet energy storage system;
a first insulator enclosing said electrically conductive wire;
a metal mesh enclosing said insulator; and
a second insulator enclosing said metal mesh,
said metal mesh contacting with said cylindrical metal box to form an electric shield.

6. A plasma jet ignition system as claimed in claim 1, wherein the winding pitch varies gradually.

7. A plasma jet ignition system as claimed in claim 1, wherein the winding pitch varies stepwise.

8. A plasma jet ignition system as claimed in claim 2, wherein said conductor has a distributed inductance.

9. A plasma jet ignition system as claimed in claim 2 or 8, including a steering diode having a cathode terminal connected to said conductor and an anode terminal connected to said plasma jet ignition plug.

10. A plasma jet ignition system as claimed in claim 3, including a steering diode having a cathode terminal connected to said conductor and an anode terminal connected to said plasma jet ignition plug.

11. A plasma jet ignition system as claimed in claim 4, wherein the winding pitch of said electrically conductive wire is relatively small in the proximity of said plasma jet ignition plug as compared to the winding pitch of said electrically conductive wire far from said plasma jet ignition plug.

12. A plasma jet ignition system as claimed in claim 2, wherein said conductor is in the form of a wire-wound noise prevention lead.

* * * * *